United States Patent [19]

Baribeau

[11] 4,210,378

[45] Jul. 1, 1980

[54] ELECTRICAL WIRE CONNECTION

[75] Inventor: Gary A. Baribeau, Troy Township, Saint Croix County, Wis.

[73] Assignee: Minnesota Mining and Manufacturing Company, Saint Paul, Minn.

[21] Appl. No.: 32,385

[22] Filed: Apr. 23, 1979

[51] Int. Cl.[2] ..... H01R 9/08

[52] U.S. Cl. ..... 339/97 R

[58] Field of Search ..... 339/96, 97, 98, 99, 339/97 R, 103 M, 97 P

[56] References Cited

U.S. PATENT DOCUMENTS

| | | | |
|---|---|---|---|
| 2,651,768 | 9/1953 | Oortgijsen | 339/97 R X |
| 3,936,128 | 2/1976 | D'Annessa | 339/103 M X |
| 3,955,873 | 5/1976 | Peterson | 339/99 R |

*Primary Examiner*—Howard N. Goldberg
*Assistant Examiner*—John S. Brown
*Attorney, Agent, or Firm*—Cruzan Alexander; Donald M. Sell; Terryl K. Qualey

[57] ABSTRACT

An electrical wire connection in which an electrically conductive connector element in an insulating body makes electrical connection to the conductor of an insulated wire. The connector element has an open-ended hollow cylindrical wire connecting end formed with a pair of opposed V-shaped wire entrance areas leading into straight sided wire connecting slots and the wire is more deeply inserted into one slot than the other.

7 Claims, 7 Drawing Figures

ELECTRICAL WIRE CONNECTION

FIELD OF THE INVENTION

The present invention relates to an electrical wire connection in which insulation on the electrical wire is cut and the conductor is indented by a connector element.

BACKGROUND OF THE INVENTION

The prior art includes electrical wire connections utilizing connector elements having hollow cylindrical wire connecting ends as disclosed in U.S. Pat. Nos. 3,955,873 and 3,964,816. Two opposed slots are formed to make wire connections, one slot providing connection to the conductor of the electrical wire and the other engaging the insulation on the wire for strain relief. In the wire connecting element disclosed in both patents the slots are differently configured to provide their different functions. However, this is undesirable where multiple contacts are to be used in an array of rows and columns since, for proper wire insertion, the slots in the contacts must be oriented in the same direction and, when in an array, it may not be readily apparent when one contact is turned 180° from its proper orientation.

To eliminate the problem of proper orientation, connector elements having hollow cylindrical wire connecting ends formed with a pair of opposed identical wire connecting slots have been utilized and the wires have been inserted similarly into both slots. However, it has been found that when the slot is made narrow enough to assure connection to the conductor in some instances the connection is mechanically too weak and even a small amount of relative movement between the wire and the connector element causes the wire to break.

SUMMARY OF THE INVENTION

The present invention provides an electrical wire connection including an insulating connector body having a receptacle for a connector element, an electrically conductive connector element within the receptacle and an insulated electrical wire conductively connected to the connector element. The connector element has an open-ended hollow cylindrical wire connecting end formed with a pair of identical opposed V-shaped wire entrance areas extending from the open end of the wire connecting end and leading into identical straight sided wire connecting slots running parallel to the axis of the wire connecting end. The insulated electrical wire is inserted into the wire connecting slots, the wire being inserted deeper into one slot than the other. The wire terminates a short distance outside of the connector element on the side thereof where it is more deeply inserted and in that slot its insulation is cut and the conductor thereof is more deeply indented by the edges of the slot to assure good electrical connection. The lesser indentation in the slot from which the majority of the wire extends lessens the indentation into the conductor and thus lessens the possibility of severing the wire if there is relative movement between the wire and the connector element.

THE DRAWING

Figure 1:
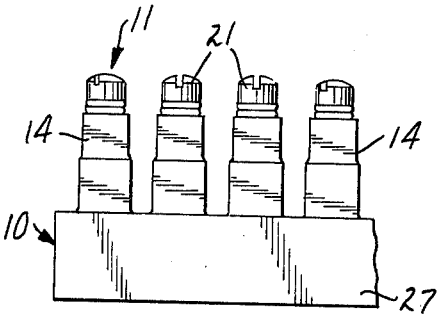
FIG. 1 is a side elevation view of a portion of a terminal block having a plurality of electrical wire connections in accordance with the present invention.
Figure 2:
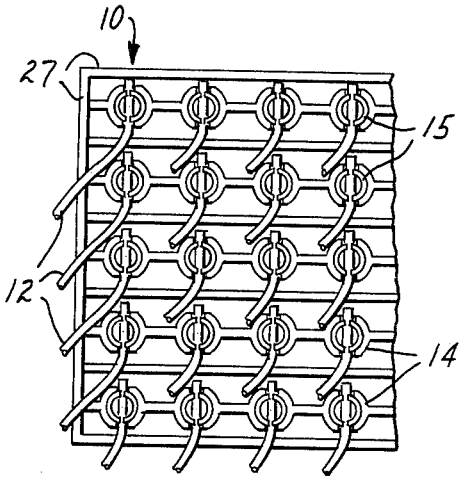
FIG. 2 is a bottom view of the terminal block of FIG. 1.
Figure 3:
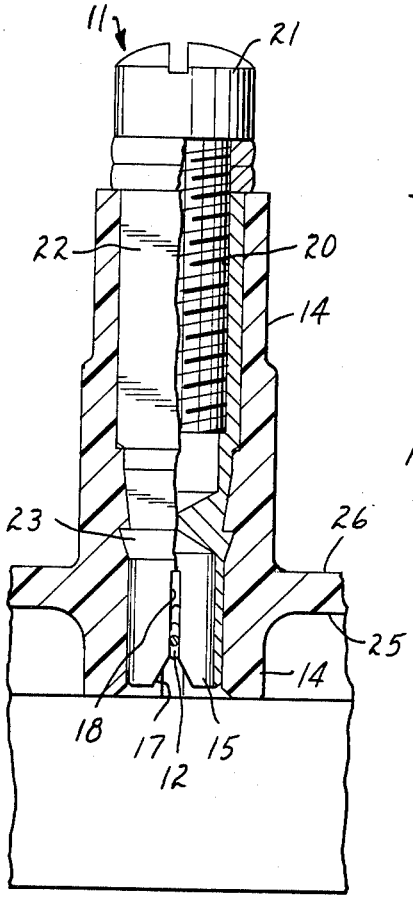
FIG. 3 is an elevation view of one electrical wire connection on the terminal block, with parts thereof sectioned.

The electrical wire connection of the present invention comprises an insulating connector body 10, an electrically conductive connector element 11 and an insulated wire 12. The illustrated embodiment of the invention is a terminal block wherein a multiplicity of wires 12 are electrically connected to connector elements 11 in an array of rows and columns. The insulating connector body 10 is formed of a plastic and it has a plurality of contact receptacles 14.

A connector element 11 is retained within each connector body receptacle 14. Each connector element 11 has an open-ended hollow cylindrical wire connecting end 15 formed with a pair of identical opposed V-shaped wire entrance areas 17 extending from the open end of the wire connecting end 15 and leading into identical straight sided wire connecting slots 18 and 19 running parallel to the axis of the wire connecting end 15. The opposite end of the connector element 11 is formed with an axially extending screw threaded bore 20 into which is threaded a complementary machine screw 21. Between the wire connecting end 15 and the opposite end of the connector element 11 the cross sectional shape of the connector element changes from cylindrical to square for the body portion 22 of the element. Between the wire connecting end 15 and the square body portion 22, the connector element 11 is formed with a sharp edged circumferential shoulder 23 which bites into the plastic of the insulating body 10 in the receptacle to retain the connector element 11 in the contact receptacle 14. The shoulder 23 also forms a water tight seal with the plastic of the insulating body 10 to prevent water from traveling down the length of the connector element 11. Application of a potting compound to the bottom of the connector block will thus waterproof the wire connections in the slots of the connector elements 11.

The insulating body 10 has a flat web with generally parallel lower and upper surfaces 25 and 26, respectively joining the connector receptacles 14, and an edge wall 27 extending around the periphery of the terminal block from the bottom surface 25 of the insulating body 10 to provide the sidewalls of a container for a potting compound. The insulating plastic of the insulating body 10 defining a connector receptacle 14 extends from both of the planar surfaces 25 and 26 surrounding and complementary in shape to a connector element 11. Thus, the contact receptacle 14 extends from the upper surface 26 of the insulating body web along the body portion 22 of the connector element 11, is square in cross section and fits closely around the body portion 22 of the connector element 11. The square portion of the receptacle 14 in conjunction with the square body portion of the connector element 11 permit the connector element 11 to be inserted into the receptacle 14 in only two different orientations and also to prevent the connector element 11 from rotating in the receptacle 14 when the screw 21 is turned into the connector element. The receptacle 14 extends from the bottom surface 25 to surround the wire connecting end 15 except along a line through the wire connecting slots 18 to provide an unobstructed path through the slots for an insulated wire 12.

The insulated wire 12 is inserted into the wire connecting slots 18 and 19 of each connector element 11, the wire being inserted deeper into slot 18 than into slot 19. The insulation on the wire 12 is cut and the conductor thereof more deeply indented by the edges of the slot 18 into which it is more deeply inserted and the wire terminates a short distance outside of the connector element on the side thereof containing slot 18.

Figure 4:
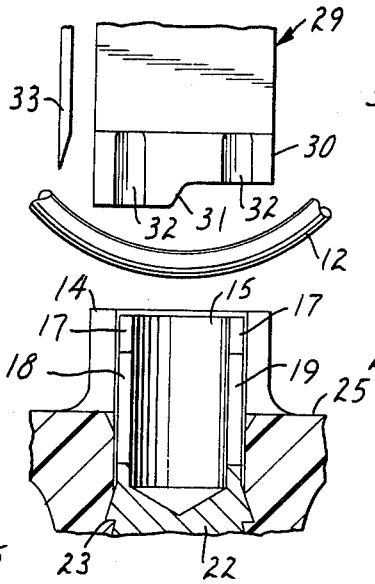
FIG. 4 is a partially sectioned elevation view of the bottom portion of one connector element in the terminal block with an insulated wire in position for insertion into the element.
Figure 5:
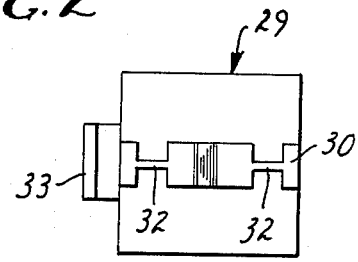
FIG. 5 is a bottom view of the wire inserter illustrated in FIG. 4.
Figure 6:
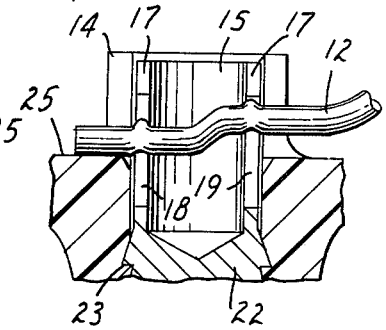
FIG. 6 is an elevation view similar to that of FIG. 4 after the wire has been fully inserted into the connector element.
Figure 7:
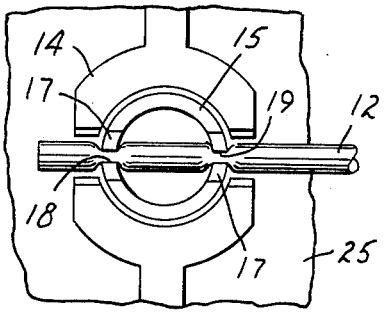
FIG. 7 is a bottom view of the connection of FIG. 6.

In FIGS. 4 and 5 there is illustrated the terminal end of an insertion tool 29 for inserting the insulated wire 12 into the slots 18 and 19 and for severing the wire adjacent slot 18. The bottom surface of the insertion tool 29 has a rib 30 formed with a step 31 for providing the differential insertion into slots 18 and 19 and thinner sections at 32 to fit into the slots 18 and 19. The insertion tool 29 also has a cut-off blade 33 for severing the wire 12 adjacent slot 18 upon insertion of the wire into connector element 11. The insertion tool 29 is formed to insert the wire 12 into slot 18 to a position where the terminal end thereof contacts the bottom surface 25 of the insulating body and into slot 19 to a position where the insulation on the wire is generally flush with the base of the V-shaped wire entrance area 17 leading into the slot 19.

One preferred embodiment of the present invention was constructed using 24 AWG insulated wire. Each connector element 11 was formed of No. 360 free cutting brass and each machine screw 21 was formed of No. 260 cartridge brass. The wire connecting end 15 of the connector element 11 had an external diameter of 4.27 mm. and a length of 5.58 mm. and an internal diameter of 3.45 mm. bored to a depth of 5.84 mm. The V-shaped wire entrance areas 17 had an axial length of 1.27 mm. with the edges thereof at 30° to the axis of the connector element 11. The wire connecting slots 18 had an axial length of 3.81 mm. and a width of 0.285 mm. The overall length of the connector element 11 was 21.84 mm. and the square body portion had a length of 11.43 mm. and was 5.54 mm. on a side. The wire was inserted into slot 19 to a depth from the top of the connector element 11 to the top of the insulation on the wire 12 of 1.78 mm. and in slot 18 to a depth of 2.54 mm. Each wire was thus inserted into slot 18 a depth of 0.76 mm. deeper than into slot 19. Good electrical connection was made in each of the connector elements 11 and the lesser depth of insertion into slot 19 provided less connection pressure which provided both strain relief and electrical connection to the conductor of the wire 12.

I claim:

1. An electrical wire connection comprising:

an insulating connector body having a receptacle for a connector element, an electrically conductive connector element within said receptacle, said element having an open-ended hollow cylindrical wire connecting end formed with a pair of identical opposed V-shaped wire entrance areas extending from the open end of said wire connecting end and leading into identical straight sided wire connecting slots running parallel to the axis of said wire connecting end, an insulated electrical wire inserted into said wire connecting slots, said wire being inserted deeper into one slot than the other, having its insulation cut and the conductor thereof more deeply indented by the edges of said slot into which it is more deeply inserted and terminating a short distance outside of said connector element on the side thereof where it is more deeply inserted into said slot.

2. The connection of claim 1 wherein said connector element receptacle extends into a generally planar surface of said insulating body, said connector element slots extend to both sides of the plane of said planar surface and said wire on said side more deeply inserted is inserted substantially to the plane of said planar surface.

3. The connection of claim 2 wherein said insulating body includes portions extending from said planar surface thereof to surround said wire connecting end except along a line through said wire connecting slots.

4. The connection of claim 1, 2 or 3 wherein said connector element is formed of No. 360 free cutting brass.

5. The connection of claim 4 wherein the end of said connector element opposite said wire connecting end is formed with an axially extending screw threaded bore.

6. The connection of claim 5 wherein said connector element includes a body portion between said connecting end and said opposite end, said body having a polygonal cross-section, and wherein said insulating body closely surrounds said body portion.

7. The connection of claim 1 wherein in said slot into which said wire is inserted the lesser depth it is inserted to a depth such that its insulation is generally flush with the base of said V-shaped wire entrance area leading into said slot.

* * * * *